US008955285B2

(12) United States Patent
Fournier et al.

(10) Patent No.: US 8,955,285 B2
(45) Date of Patent: Feb. 17, 2015

(54) EMBEDMENT ATTACHMENT SYSTEM

(71) Applicant: Illinois Tool Works, Inc., Glenview, IL (US)

(72) Inventors: James C. Fournier, Gurnee, IL (US); Larry Moeller, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/827,236

(22) Filed: Mar. 14, 2013

(65) Prior Publication Data

US 2014/0157718 A1 Jun. 12, 2014

Related U.S. Application Data

(60) Provisional application No. 61/374,724, filed on Dec. 7, 2012.

(51) Int. Cl.
*E04B 1/38* (2006.01)
*E04B 1/41* (2006.01)
*E04B 2/88* (2006.01)

(52) U.S. Cl.
CPC ..... *E04B 1/4107* (2013.01); *E04B 2/88* (2013.01)
USPC ..... 52/707; 52/463; 52/509

(58) Field of Classification Search
CPC ..... E04B 2/96; E04B 2/94; E04B 2/90; E06B 3/5427
USPC ..... 52/235, 509, 704, 463, 707, 698, 699, 52/708, 710, 385, 508
See application file for complete search history.

(56) References Cited

U.S. PATENT DOCUMENTS

| | | | | |
|---|---|---|---|---|
| 975,242 | A | | 11/1910 | Higgins et al. |
| 1,199,077 | A | | 9/1916 | James |
| 1,382,082 | A | | 6/1921 | Heltzel |
| 1,643,578 | A | | 9/1927 | Eaton et al. |
| 1,929,835 | A | * | 10/1933 | Awbrey ..... 52/709 |
| 2,163,446 | A | * | 6/1939 | Heckman ..... 52/709 |
| 2,301,306 | A | | 11/1942 | McDonald |
| 2,971,616 | A | | 2/1961 | Bayley, Jr. |
| 3,124,222 | A | | 3/1964 | Mote |
| 3,219,308 | A | | 11/1965 | Halstead |
| 3,266,207 | A | | 8/1966 | Birum, Jr. |
| 3,266,210 | A | | 8/1966 | Abraham |

(Continued)

FOREIGN PATENT DOCUMENTS

| | | |
|---|---|---|
| EP | 1 467 038 A1 | 10/2004 |
| EP | 1 688 551 A1 | 8/2006 |

OTHER PUBLICATIONS

International Search Report and Written Opinion of the International Searching Authority for PCT/US2013/072389, dated Mar. 3, 2014 (10 pages).

(Continued)

*Primary Examiner* — James Ference
(74) *Attorney, Agent, or Firm* — Neal, Gerber & Eisenberg LLP

(57) ABSTRACT

Various embodiments of the present disclosure provide an embedment attachment system configured to attach to a concrete form such that an embedment of the embedment attachment system has a desired edge spacing from the concrete form. Use of the embedment attachment system of the present disclosure enables precise embedment positioning with respect to the concrete form.

31 Claims, 13 Drawing Sheets

(56) References Cited

U.S. PATENT DOCUMENTS

| | | | | | |
|---|---|---|---|---|---|
| 3,316,681 | A | | 5/1967 | Eber | |
| 3,376,010 | A | | 4/1968 | Myer | |
| 3,719,014 | A | | 3/1973 | Sukolics | |
| 3,797,191 | A | | 3/1974 | Sukolics | |
| 3,912,218 | A | | 10/1975 | Lister et al. | |
| 3,936,986 | A | | 2/1976 | Steel | |
| 3,960,356 | A | | 6/1976 | Adams | |
| 3,963,210 | A | | 6/1976 | Macklin | |
| 3,974,608 | A | | 8/1976 | Grearson | |
| 4,009,549 | A | | 3/1977 | Hala | |
| 4,055,923 | A | | 11/1977 | Biebuyck | |
| 4,074,486 | A | | 2/1978 | Grearson | |
| 4,261,544 | A | | 4/1981 | Addison | |
| 4,307,551 | A | | 12/1981 | Crandell | |
| 4,418,506 | A | | 12/1983 | Weber et al. | |
| 4,423,576 | A | | 1/1984 | Farina et al. | |
| 4,506,482 | A | | 3/1985 | Pracht et al. | |
| 4,543,755 | A | | 10/1985 | Crandell | |
| 4,577,450 | A | | 3/1986 | Large | |
| 4,644,711 | A | | 2/1987 | Eickhof | |
| 4,662,145 | A | | 5/1987 | Tanikawa et al. | |
| 4,685,263 | A | | 8/1987 | Ting | |
| 4,712,345 | A | | 12/1987 | Kaminaga | |
| 4,738,065 | A | | 4/1988 | Crandell | |
| 4,768,322 | A | | 9/1988 | Kafarowski | |
| 4,782,635 | A | | 11/1988 | Hegle | |
| 4,783,941 | A | | 11/1988 | Loper et al. | |
| 4,798,035 | A | | 1/1989 | Mitchell et al. | |
| 4,831,805 | A | | 5/1989 | Noborisaka et al. | |
| 4,899,508 | A | | 2/1990 | Biebuyck | |
| 4,903,454 | A | | 2/1990 | Rose | |
| 4,905,435 | A | | 3/1990 | Horst | |
| 4,905,444 | A | | 3/1990 | Semaan | |
| 4,948,313 | A | * | 8/1990 | Zankovich | 411/85 |
| 4,951,438 | A | | 8/1990 | Thoresen | |
| 5,048,254 | A | | 9/1991 | Merlau | |
| 5,063,718 | A | | 11/1991 | Nonis | |
| 5,067,272 | A | | 11/1991 | Constantz | |
| 5,067,292 | A | * | 11/1991 | Finean | 52/235 |
| 5,118,060 | A | | 6/1992 | Spronken | |
| 5,197,255 | A | * | 3/1993 | Fricker | 52/703 |
| 5,239,798 | A | | 8/1993 | Saito | |
| 5,240,543 | A | | 8/1993 | Fetterhoff | |
| 5,390,468 | A | | 2/1995 | Probst | |
| 5,449,542 | A | | 9/1995 | Chiba et al. | |
| 5,548,939 | A | | 8/1996 | Carmical | |
| 5,623,804 | A | * | 4/1997 | Kelly et al. | 52/704 |
| 5,711,122 | A | * | 1/1998 | Lee | 52/283 |
| 5,890,340 | A | * | 4/1999 | Kafarowski | 52/704 |
| 6,282,860 | B1 | | 9/2001 | Ramirez | |
| 6,591,562 | B2 | * | 7/2003 | Ting | 52/235 |
| 6,598,361 | B2 | * | 7/2003 | Ting | 52/235 |
| 6,658,804 | B2 | | 12/2003 | Leytes et al. | |
| 6,729,080 | B1 | | 5/2004 | Zambelli et al. | |
| 7,237,368 | B2 | * | 7/2007 | Richardson et al. | 52/707 |
| 7,654,057 | B2 | * | 2/2010 | Zambelli et al. | 52/710 |
| 7,681,366 | B2 | | 3/2010 | De Gobbi | |
| 8,209,924 | B2 | * | 7/2012 | Foley | 52/289 |
| 8,234,832 | B2 | * | 8/2012 | Birnbaum et al. | 52/710 |
| 2003/0033764 | A1 | | 2/2003 | Ting | |
| 2003/0217521 | A1 | * | 11/2003 | Richardson et al. | 52/92.2 |
| 2004/0079038 | A1 | | 4/2004 | Crooker | |
| 2007/0039258 | A1 | | 2/2007 | Walker | |
| 2008/0222981 | A1 | | 9/2008 | De Gobbi | |
| 2009/0255206 | A1 | * | 10/2009 | Walker, III | 52/699 |
| 2010/0257812 | A1 | | 10/2010 | Schultz et al. | |
| 2013/0051903 | A1 | | 2/2013 | Ra | |

OTHER PUBLICATIONS

RC System Rebar Clip System, Red Head Concrete Anchoring and Reinforcing Solutions, available at http://www.itwredhead.ca/admin/pdf/201202091056RC-system.pdf, Illinois Tool Works, Inc. Copyright 2011 (4 pages).

* cited by examiner

EMBEDMENT ATTACHMENT SYSTEM

PRIORITY CLAIM

This application is a non-provisional of, and claims priority to and the benefit of, U.S. Provisional Patent Application No. 61/734,724, filed on Dec. 7, 2012, the entire contents of which are incorporated herein by reference.

BACKGROUND

Budding envelopes of certain commercial and mixed use residential buildings include a curtain wall. The curtain wall of a building defines the appearance of the budding and, more importantly, separates the interior controlled or conditioned space from the outside environment. The curtain wall is usually formed from a plurality of curtain wall panels that typically contain glass, metal, and/or stone. The curtain wall panels are attached to the building's structural elements via anchors and curtain wall panel hanging brackets (sometimes referred to as curtain wall panel brackets or panel brackets). The anchors are located at discrete attachment points along the edges of the building's concrete floor slabs. The anchors typically include embedments (sometimes referred to as embeds) that are each cast into a concrete floor slab and that may be located on the top of the slab, on the face of the slab, or beneath the slab. A panel bracket is attached to each embedment, and a curtain wall panel is hung from each panel bracket.

For a given concrete floor slab, before the concrete that forms that concrete floor slab is poured into the concrete form, an array of rebar, metallic cables, and/or other material used to reinforce the concrete floor slab is installed within the concrete form. Embedments are then positioned along an edge of the concrete form by a worker using a tape measure and control lines provided by the general contractor. That is, the worker typically uses the tape measure to hand measure where to position each embedment along the edge of the concrete form using the control lines for reference, though in certain instances the embedments are positioned along the edge of the concrete form with the aid of survey equipment.

This installation process requires another measurement by the worker to assure the embedment has the proper edge spacing from the concrete form (i.e., to ensure the embedment is located at the proper distance from the edge of the concrete form). More specifically, after determining the position along the edge of the concrete form at which to attach the embedment, the worker must then use the tape measure to hand measure the distance of the embedment from the edge of the concrete form. The worker then anchors the embedment into place by either nailing the embedment to the concrete form, wire tying the embedment to rebar, or wire tying the embedment to scraps of lumber and then nailing the lumber to the concrete form such that the anchored embedment has the proper edge spacing from, and is positioned at the desired position along the edge of, the concrete form.

Concrete is then poured into the concrete form, typically via a high pressure concrete pumping hose. Concrete pumping hoses are heavy and unwieldy, and typically require multiple workers to control and operate the concrete pumping hose while walking on and around the rebar, metallic cables, and/or other reinforcing materials within the concrete form. As and after the concrete is being poured (pumped) into the concrete form, several workers level the poured concrete, which again involves the workers walking on and around the rebar, metallic cables, and/or other reinforcing materials. This movement, shifting, and jostling of the rebar, metallic cables, and/or other reinforcing materials, along with the vibration of the concrete pumping hose and the movement of the poured concrete itself, is problematic because it may alter the position of one or more of the embedments or dislodge one or more of the embedments.

Sometime after the concrete has been poured, each embedment must be located and exposed, which sometimes requires workers to chip away any concrete that may be covering the embedment. After the embedments are located and exposed, a survey is conducted to determine whether any of the embedments are potentially problematic. More specifically, the survey is conducted to determine whether any embedments are missing, any embedments are buried too deep within the concrete floor slab, any embedments are improperly positioned or misaligned, and/or whether any embedments conflict with other features of the budding. After the survey is completed, any problematic embedments must be fixed before panel brackets are attached. For example, if an embedment is missing, is buried too deep within the concrete slab; is improperly positioned or misaligned, or conflicts with another feature of the building, a panel bracket may not be able to be properly mounted to that embedment. In such a case, mounting hardware for the panel bracket must be secured directly to the concrete floor slab by post-drilling into the concrete floor slab and securing the mounting hardware via wedge bolts and/or chemical bonding.

After any problematic embedments are fixed, a panel bracket is attached to each embedment using fasteners. For each floor of the building, the panel brackets on that floor are leveled relative to one another such that they are all planar and at a proper elevation so the installed curtain wall panels will be level and properly spaced relative to one another. The curtain wall panels are then individually hoisted into their respective final positions using a tower crane, truck crane, or mini crane.

The process of installing the embedments can result in a variety of problems caused by human error. Specifically, human error in measuring the distance from the embedment to the edge of the concrete form and/or in attaching the embedment to the form can cause the embedment to be improperly spaced from the edge of the concrete form (i.e., to not have the proper edge spacing). Additionally, once the embedments are positioned and attached to the concrete form, the embedments are inherently unstable before and during the pouring of concrete into the concrete form and the leveling of the poured concrete. For instance, if a worker bumps into or steps on the embedment or the reinforcing material to which the embedment is attached, the embedment could be moved out of place such that it no longer has the proper edge spacing or is dislodged entirely. Further, the embedments can be covered with concrete during pouring, requiring a worker to chip away cured concrete to uncover each embedment. Additionally, the process of attaching a panel bracket to each embedment is labor intensive, expensive, and time consuming.

There is a need for new apparatuses and methods for positioning embedments at the proper edge spacing from the concrete form that solve the above problems.

SUMMARY

Various embodiments of the present disclosure provide an embedment attachment system configured to solve the above-described problems. The embedment attachment system of the present disclosure is configured to position an embedment such that the embedment has the proper edge spacing from a concrete form. In other words, use of the embedment attachment system of the present disclosure enables precise embedment positioning with respect to the concrete form.

In one embodiment, the embedment attachment system is a front mount embedment attachment system defining a mounting pocket. In this embodiment, the embedment attachment system includes a panel bracket holder that defines a mounting pocket and includes an embedment, a panel bracket attachable to the embedment within the mounting pocket, and a removable protective cover attached to the panel bracket holder and covering the mounting pocket and the panel bracket mounted therein. The panel bracket holder includes a plurality of fastening flanges that are used to mount the embedment attachment system to a concrete form. The embedment is positioned within the panel bracket holder such that when the embedment attachment system is mounted to a concrete form, the embedment has the proper edge spacing from the concrete form.

In another embodiment, the embedment attachment system is a front mount embedment attachment system. In this embodiment, the embedment attachment system includes an embedment attached to an embedment hanger. The embedment hanger includes two hanger arms, each of which has an L-shaped cross section and a hanger tab, and a supporting cross brace connecting the hanger arms. In this embodiment, the embedment attachment system is attached to a concrete form by hanging the embedment attachment system off of a top surface of the concrete form using the hanger tabs and fastening the embedment hanger to the concrete form. The hanger arms are sized such that the embedment has the proper edge spacing from the concrete form when the embedment attachment system is attached to the concrete form.

In another embodiment, the embedment attachment system is a top mount embedment attachment system. In this embodiment, the embedment attachment system includes an embedment, a plurality of embedment positioners, and at least one embedment support attachable to a stud extending from the embedment and configured to support the stud at a desired height. Here, for each of the embedment positioners, a first end of that embedment positioner is configured to attach to the embedment, and a second end of that embedment positioner is configured to be fastened to a top surface of the concrete form. The embedment support is attached to and supports one of the studs (and, therefore, supports the embedment) at the desired height. The embedment positioners are sized such that the embedment has the proper edge spacing from the concrete form when the embedment attachment system is attached to the concrete form.

Additional features and advantages of the present invention are described in, and will be apparent from, the following Detailed Description and the Figures.

DETAILED DESCRIPTION OF EXAMPLE EMBODIMENTS

Figure 1A:
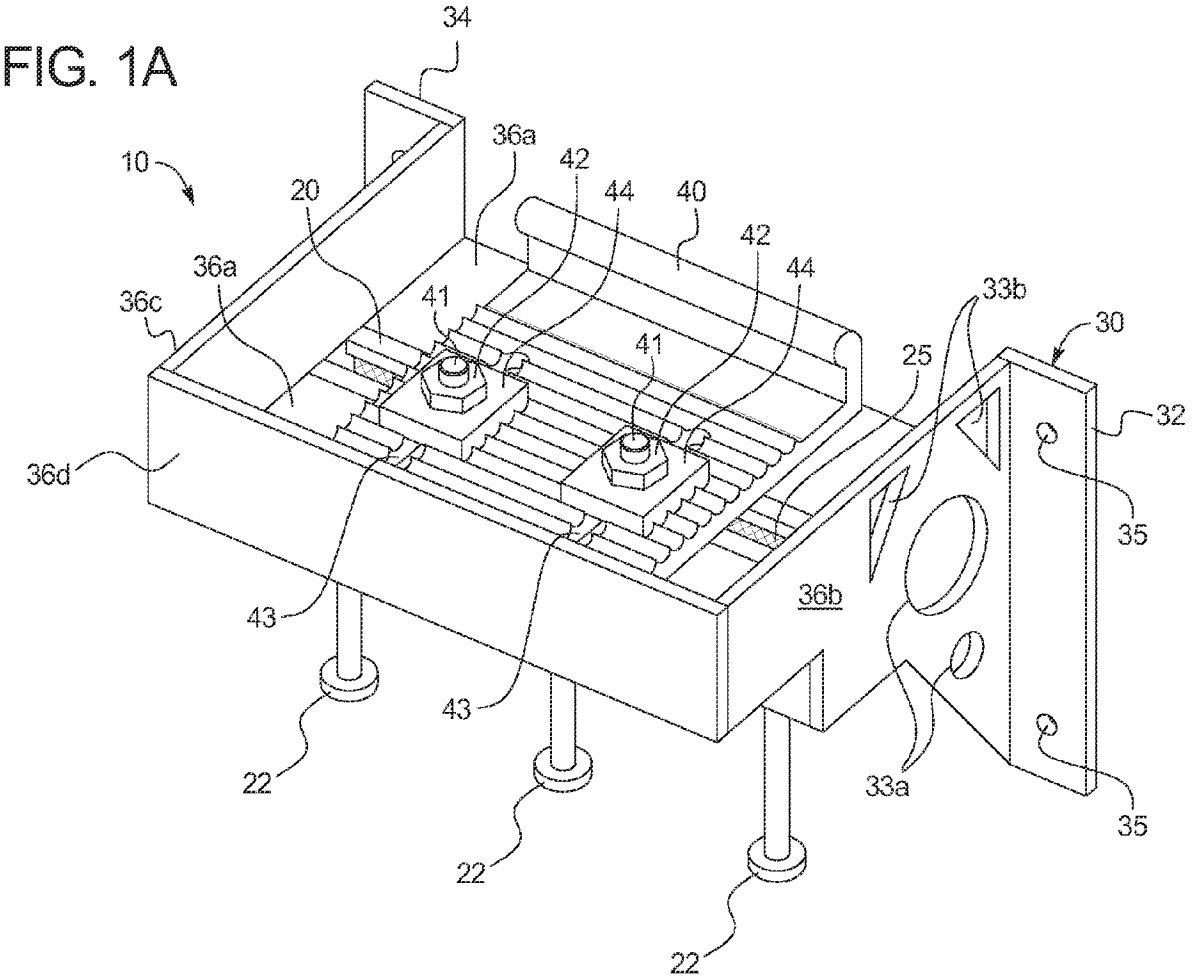
FIG. 1A is a perspective view of an example embodiment of the embedment attachment system of the present disclosure without the protective cover.
Figure 1B:
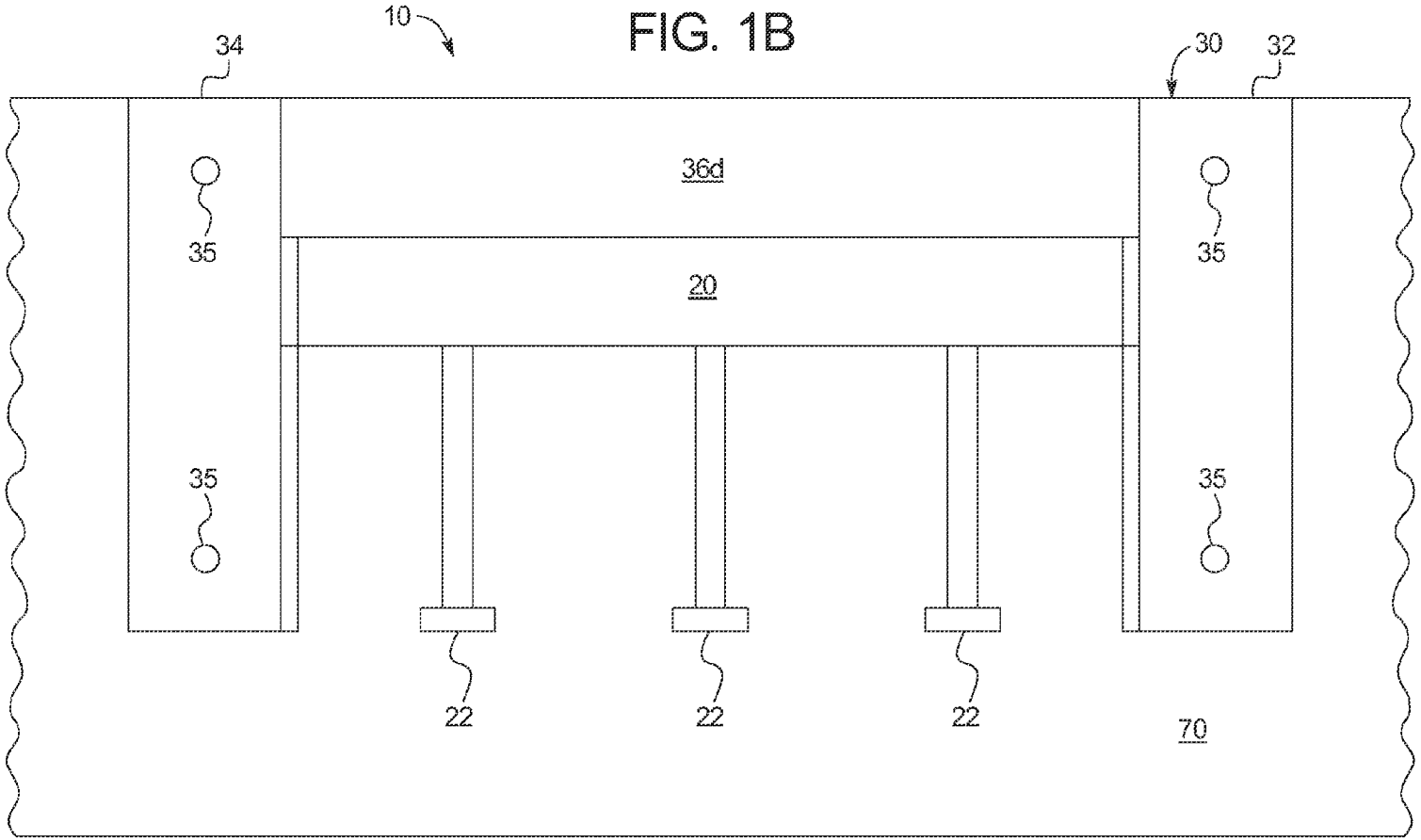
FIG. 1B is a front view of the embedment attachment system of FIG. 1A.
Figure 1C:
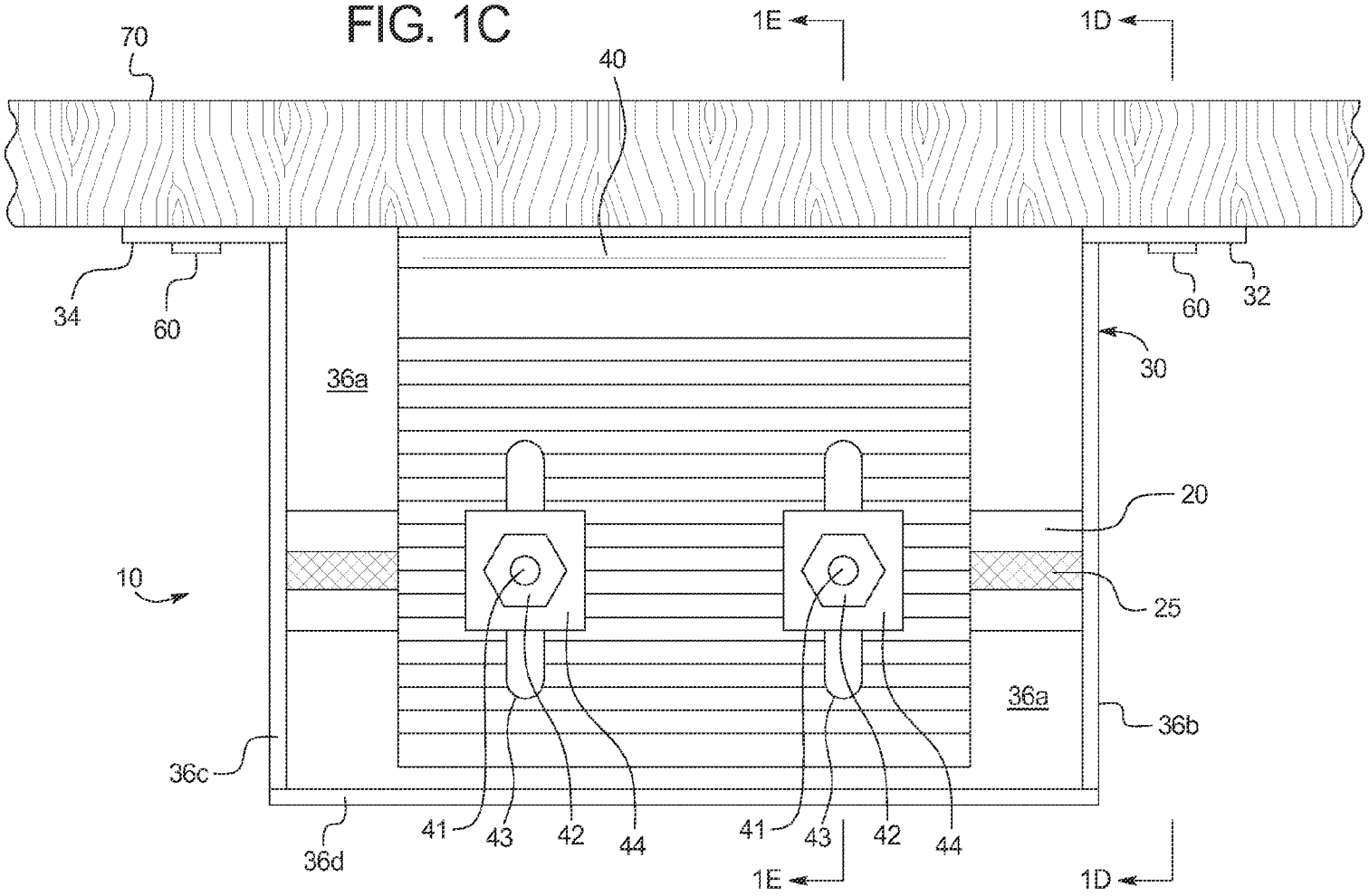
FIG. 1C is a top view of the embedment attachment system of FIG. 1A.

Various example embodiments of the embedment attachment of the present disclosure are described below and illustrated in the accompanying Figures. The embedment attachment of the present disclosure is configured to position an embedment such that the embedment has a proper edge spacing from a concrete form. In other words, use of the embedment attachment system enables precise embedment positioning with respect to the concrete form.

Front Mount Embedment Attachment System Defining a Mounting Pocket

Turning now to the Figures and particularly to FIGS. 1A, 1B, 1C, 1D, 1E, 1F, 1G, and 1H, one example embodiment of the embedment attachment system of the present disclosure is generally indicated by numeral 10. In this illustrated example, the embedment attachment system 10 includes a panel bracket holder 30, a panel bracket 40 attachable to the panel bracket holder 30 within a mounting pocket defined by the panel bracket holder 30, and a set of mounting hardware configured to mount the panel bracket 40 to the panel bracket holder 30.

In this example, the panel bracket holder 30 includes two spaced-apart base plates 36*a* and an embedment 20 attached to and positioned between the base plates 36*a*. The embedment 20 includes a plurality of downwardly extending studs 22 and defines an embedment channel 25 therethrough that is configured (along with the set of mounting hardware) to mount the panel bracket 40 to the panel bracket holder 30, as described below. The panel bracket holder 30 also includes two spaced-apart side plates 36*b* and 36*c* attached to, extending upward from, and oriented substantially perpendicular to opposite sides of the base plates 36*a* and the embedment 20. The panel bracket holder 30 further includes a front plate 36*d* attached to and oriented substantially perpendicular to the side plates 36*b* and 36*c* and attached to, extending upward from, and oriented substantially perpendicular to one of the base plates 36*a*. The base plates 36*a*, the embedment 20, the side plates 36*b* and 36*c*, and the front plate 36*d* together define the mounting pocket within which the panel bracket 40 is mounted, as described below.

The side plates 36*b* and 36*c* each define one or more material passages 33 therethrough. In this illustrated example, the material passages 33*a* are circular in shape, and the material passages 33*b* are triangular in shape, though it should be appreciated that the material passages 33 may take any suitable shape (such as the shapes illustrated in FIG. 1G and described below) and have any suitable size. Concrete may flow through the material passages when being poured into the concrete form, which helps assure uniform concrete distribution throughout the concrete form, facilitates the concrete consolidation process, and reduce the potential for air pockets to be created in the cured concrete. Rebar, metallic cables, or other material used to reinforce the cured concrete slab may also be threaded through the material passages, facilitating concrete reinforcement near the edges of the concrete slab.

The panel bracket holder 30 further includes a first fastening flange 32 attached to, extending to the right of, and oriented substantially perpendicular to the side plate 36*b*, and a second fastening flange 34 attached to, extending to the left of, and oriented substantially perpendicular to the side plate 36*c*. The first and second fastening flanges 32 and 34 define one or more fastener receiving openings 35 therethrough, which enable the panel bracket holder 30, and the embedment attachment system 10 as a whole, to be mounted to a concrete form 70, as described below.

In other embodiments, the panel bracket holder includes a single fastening flange connected to and extending downward from the base plate proximate the concrete form. In one example, the fastening flange is located at the approximate midpoint of that edge of the base plate. In one such embodiment, the single fastening flange is reinforced by a brace connected to the base plate and/or the embedment.

In this example, the plates and flanges of the panel bracket holder 30 are attached to one another via welds, though it should be appreciated that the plates and flanges of the bracket holder may be attached to one another in any suitable manner. Additionally, in this example, the embedment is attached to the base plates via welds, though it should be appreciated that the embedment may be attached to the base plates in any suitable manner.

The set of mounting hardware includes two t-bolts 41, two corresponding locking washers 44, and two corresponding nuts 42. To mount the panel bracket 40 to the panel bracket holder 30 within the mounting pocket in this example, the t-bolts 41 are inserted into the embedment channel 25 of the embedment 20 and rotated approximately ninety degrees such that they are "locked" into the embedment channel 25. As best shown in FIG. 1E, the panel bracket holder 40 is then placed over the t-bolts 41 such that each t-bolt 41 passes through one of a plurality of slotted mounting openings 43 defined by the panel bracket holder 40. The slotted mounting openings are oriented substantially parallel to the side plates 36*b* and 36*c*, which enables a worker to slide the panel bracket from right to left or left to right (with respect to the orientation shown in FIG. 1E) to alter its position with respect to the edge of the concrete form before installing the locking washer and tightening the nut. It should be appreciated that, in other embodiments, the mounting openings are any suitable shape (such as circular).

As best shown in FIG. 1E, one of the locking washers 44 is passed over each t-bolt 41 until a plurality of locking ridges on the underside of the locking washer 44 engage a plurality of locking ridges on the upper surface of the panel bracket 40. One of the nuts 42 is then threaded onto each of the t-bolts 41 and tightened against the corresponding locking washer 44. It should be appreciated that the engagement of the locking ridges of the locking washer 44 with the locking ridges of the panel bracket 40 prevents the panel hanger 40 from sliding from right to left or from left to right (with respect to the orientation shown in FIG. 1E) when the locking washer is installed and the nut tightened. It should be appreciated that any suitable mounting hardware may be used to mount the panel bracket to the panel bracket holder.

Figure 1D:
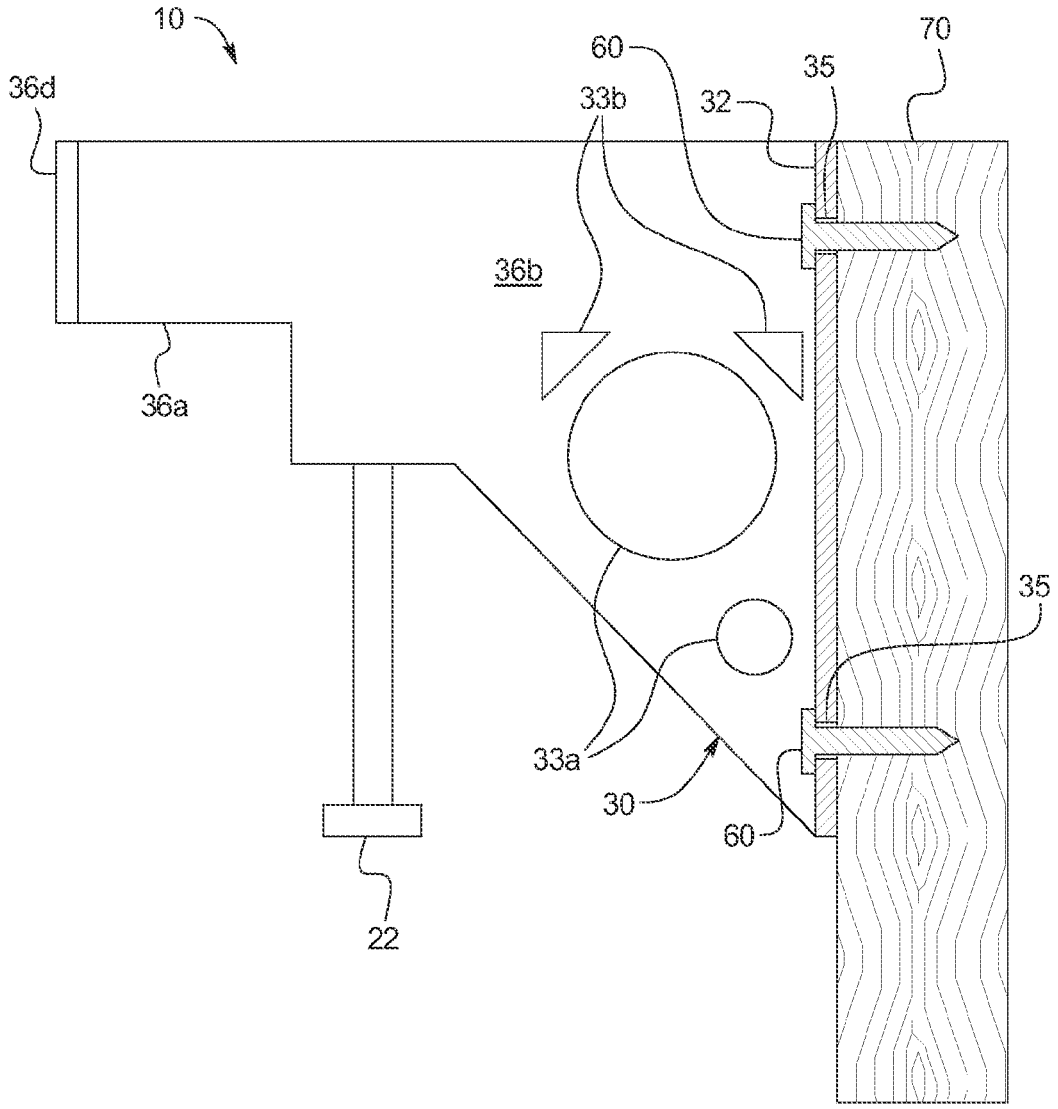
FIG. 1D is a cross-sectional side view of the embedment attachment system of FIG. 1A taken substantially along line 1D-1D of FIG. 1C.
Figure 1E:
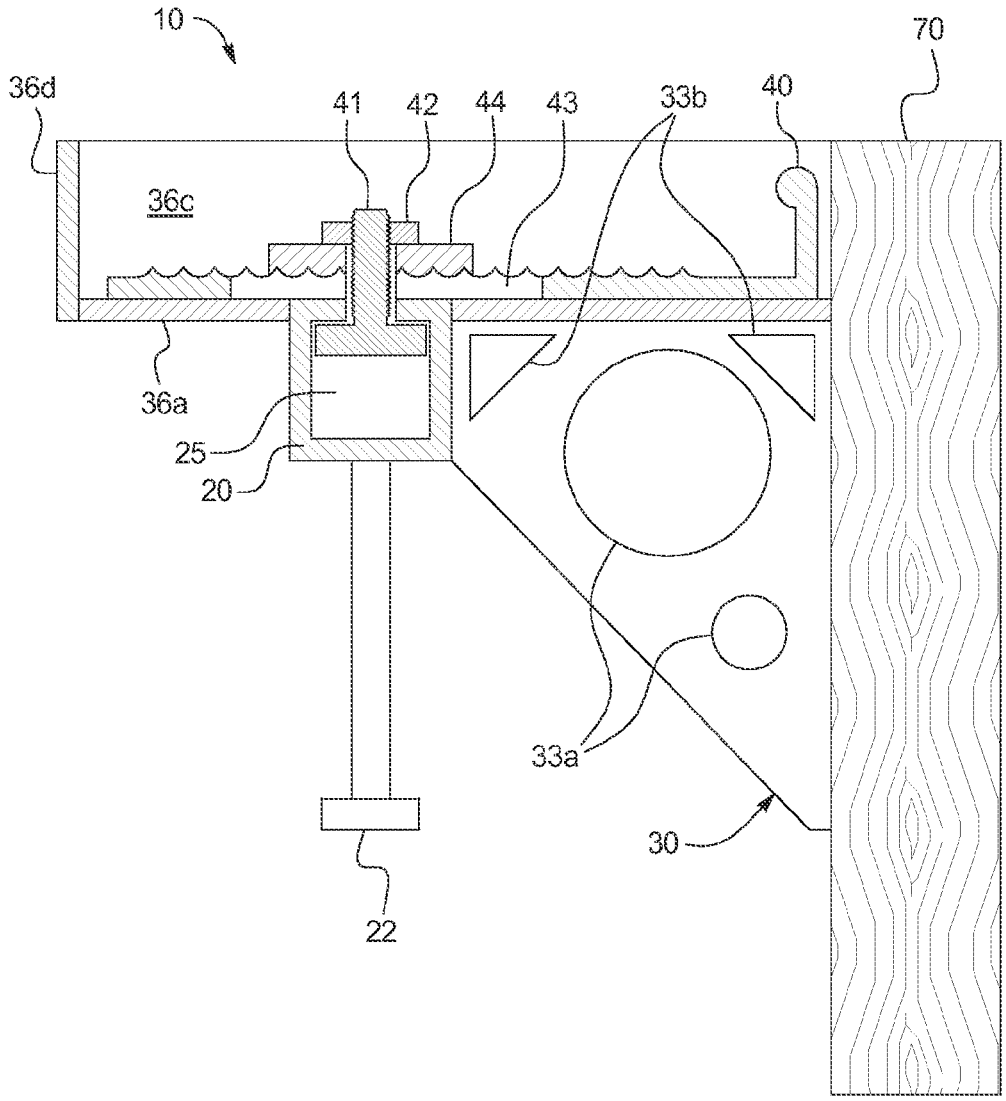
FIG. 1E is a cross-sectional side view of the embedment attachment system of FIG. 1A taken substantially along line 1E-1E of FIG. 1C.
Figure 1F:
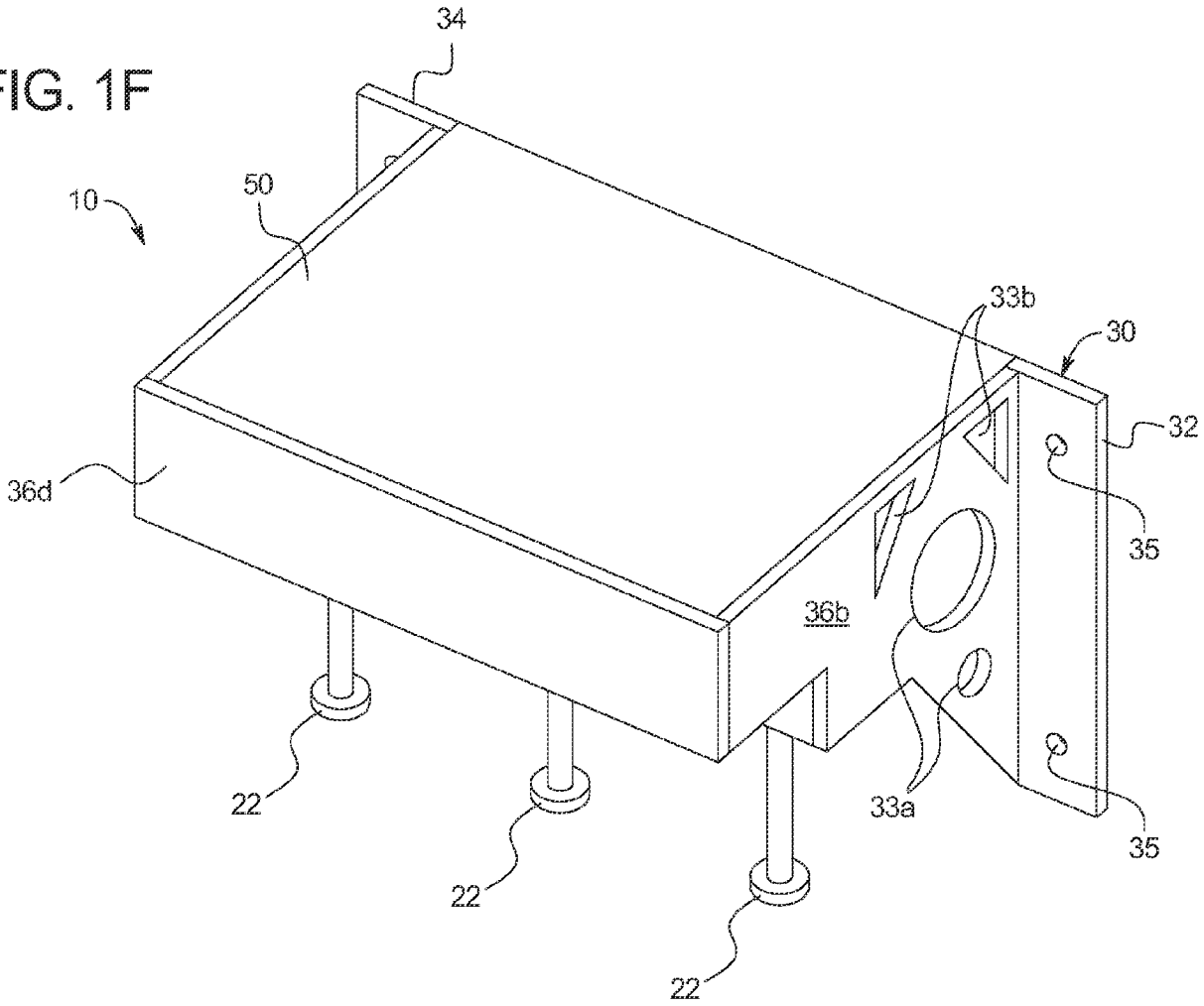
FIG. 1F is a perspective view of the embedment attachment system of FIG. 1A including the protective cover.
Figure 1G:
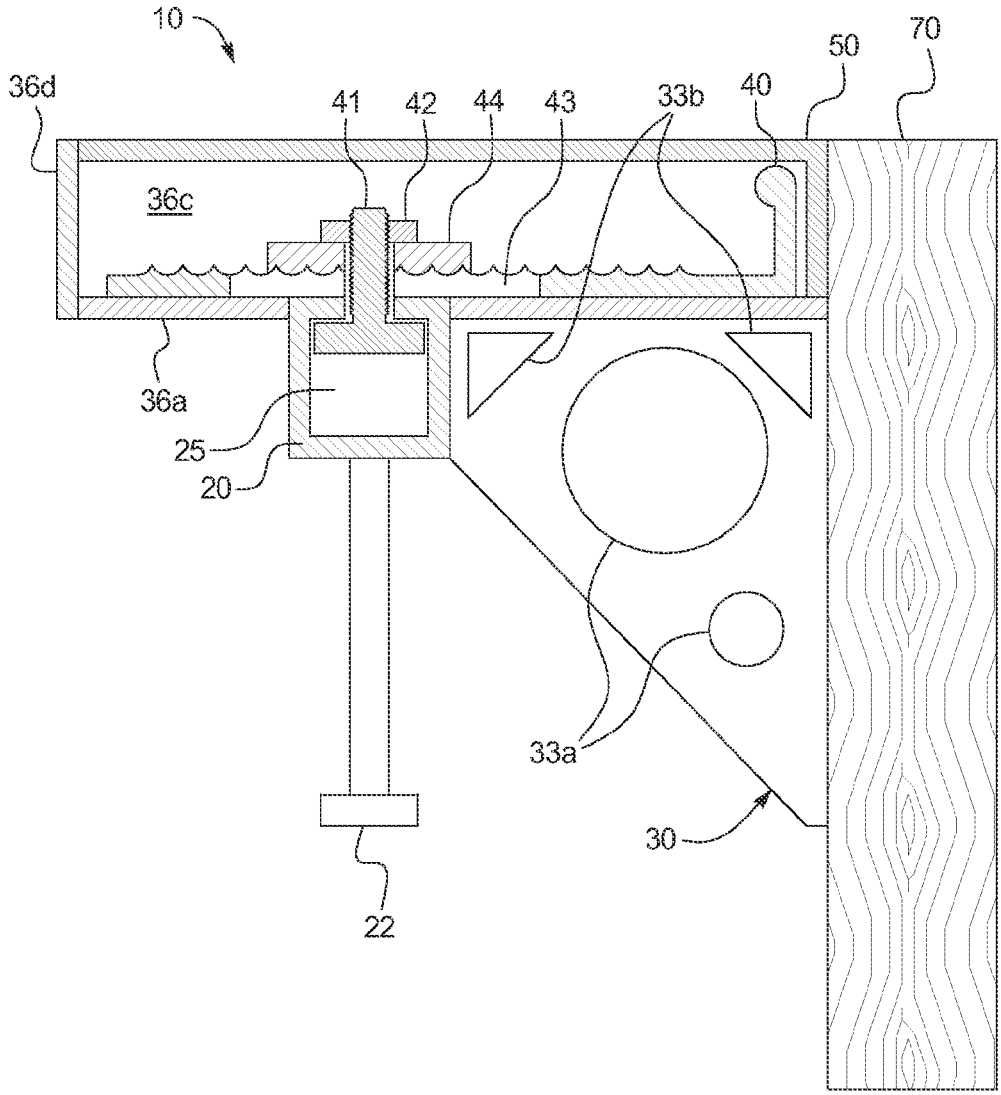
FIG. 1G is a cross-sectional side view of the embedment attachment system of FIG. 1F including the protective cover taken substantially along line 1G-1G of FIG. 1F.
Figure 1H:
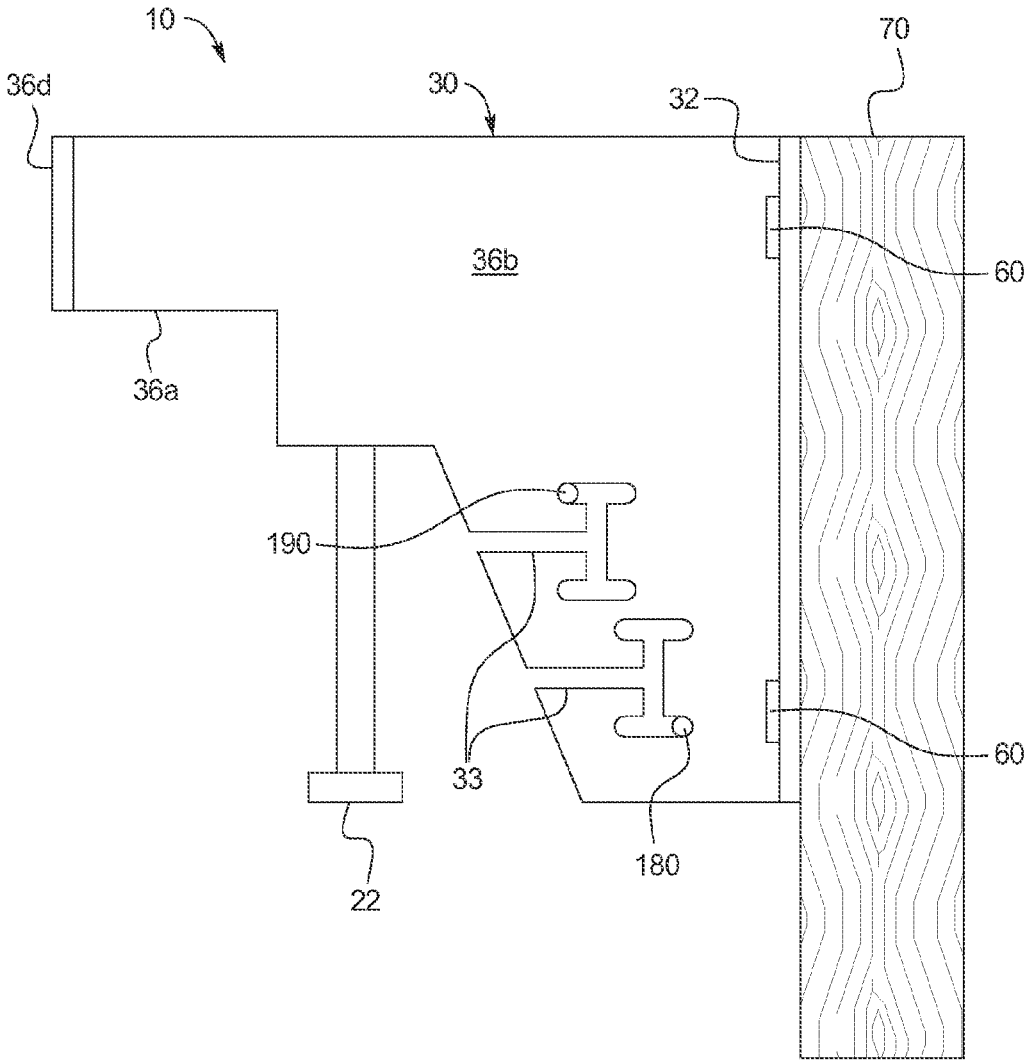
FIG. 1H is a side view of another example embodiment of the embedment attachment system of the present disclosure.

As illustrated in FIGS. 1F and 1G, the embedment attachment system 10 includes a removable protective cover 50 attachable to the side plates 36*b* and 36*c* and/or the front plate 36*a* of the panel bracket holder 30. The protective cover has an L-shaped cross section such that when it is attached to the panel bracket holder, the protective cover covers and encloses the mounting pocket (and the panel bracket mounted therein), thereby preventing concrete from entering the embedment channel, from covering the panel bracket, and from covering the mounting hardware while the concrete is being poured into the concrete form. It should be appreciated that the protective cover may be attached to the panel bracket holder in any suitable manner, such as by an ultrasonic seal, an adhesive, a friction fit, or a snap fit.

As illustrated in FIG. 1D, the embedment attachment system 10 is configured to be attached to the concrete form 70 via fasteners 60 inserted through the fastener receiving openings 35 and into the concrete form 70. More specifically, the first and second fastening flanges 32 and 34 are held flush against the interior face of the concrete form 70, positioned such that the tops of the first and second fastening flanges 32 and 34 are located at the top of the concrete form 70 (as shown in FIG. 1G) or at a designated distance from the top of concrete form 70, and fastened into place. Any suitable fasteners, such as nails, tacks, screws, staples, or bolts, may be used to attach the embedment attachment system to the concrete form.

As noted above, FIG. 1G illustrates another embodiment of the embedment attachment system of the present disclosure in which the material openings defined by the side plates are T-shaped and extend to the edges of the side plates. In this embodiment, reinforcing material 180 and 190 (such as rebar) may be installed before the embedment attachment system is attached to the concrete form and then snapped or guided into the material openings 33 upon attachment of the embedment attachment system to the concrete form. In other words, the material openings in this illustrated embodiment enable the embedment attachment system to be installed after and around the rebar or metallic cables.

It should be appreciated that after the embedment attachment system is attached to the concrete form, the fastening flanges prevent the embedment attachment system from being dislodged or from being shifted from its installed position when jostled, stepped on, or otherwise disturbed. Additionally, the components of the embedment attachment system are configured such that, after the embedment attachment system is attached to the concrete form, the embedment has the proper edge spacing from the concrete form. In other words, use of the embedment attachment system enables precise embedment positioning with respect to the concrete form.

The components of the embedment attachment system may be made from any suitable materials. In certain embodiments, the components of the embedment attachment system are made from the same material, while in other embodiments at least two of the components of the embedment attachment system are made from different materials. For instance, in one example, the panel bracket holder, the panel bracket, and the protective cover are made from aluminum. In another example, the panel bracket holder and the panel bracket are made from aluminum and the protective cover is plastic.

It should be appreciated that the embedment attachment system may include any suitable combination of the above-referenced components. In one embodiment, the embedment attachment system includes the panel bracket holder, the protective cover, the panel bracket, and the mounting hardware. In another embodiment, the embedment attachment system includes the panel bracket holder and the protective cover. In another embodiment, the embedment attachment system includes the panel bracket holder.

This example embedment attachment system solves the above-described problems. More specifically, the configuration of the components of the embedment attachment system does not require a worker to use a tape measure to ensure the embedment has the proper edge spacing from the concrete form, thereby eliminating the potential for human error with respect to this measurement. The embedment attachment system is also not attached to the rebar (or any other reinforcing materials), which reduces the likelihood that any jostling of the rebar will displace the embedment from its desired location. Additionally, since the panel bracket is pre-mounted to the embedment, the labor, expense, and time associated with mounting a panel bracket to each embedment after the concrete is poured and cured is reduced or eliminated.

The removable protective cover protects the embedment, the panel bracket, and the mounting hardware from being covered in concrete during pouring, reducing the labor, expense, and time required to locate each embedment and chip away cured concrete to expose each embedment. Further, the fastening flanges provide stability and reduce the likelihood that the embedment attachment system will be dislodged (such as when stepped on by a worker), which reduces the likelihood that the embedment will be displaced from its desired location. Additionally, the material passages provide passageways through which concrete may pass through during pouring, which maximizes strength of the formed concrete slab and facilitates the concrete consolidation process. The material passages also enable rebar, metallic cables, and/or other reinforcing materials to pass through without contacting the embedment attachment system, reducing the likelihood that any jostling of those reinforcing materials will displace the embedment from its desired location.

Front Mount Embedment Attachment System

Figure 2A:
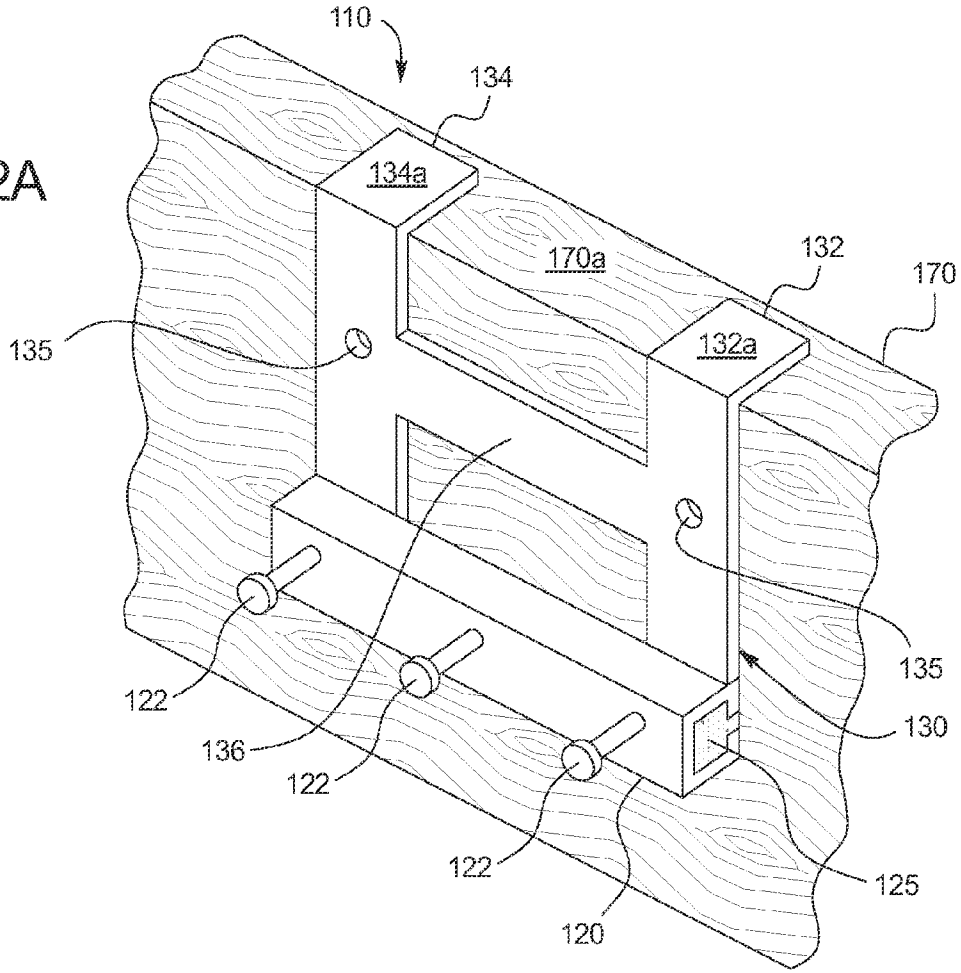
FIG. 2A is a perspective view of another example embodiment of the embedment attachment system of the present disclosure.
Figure 2C:
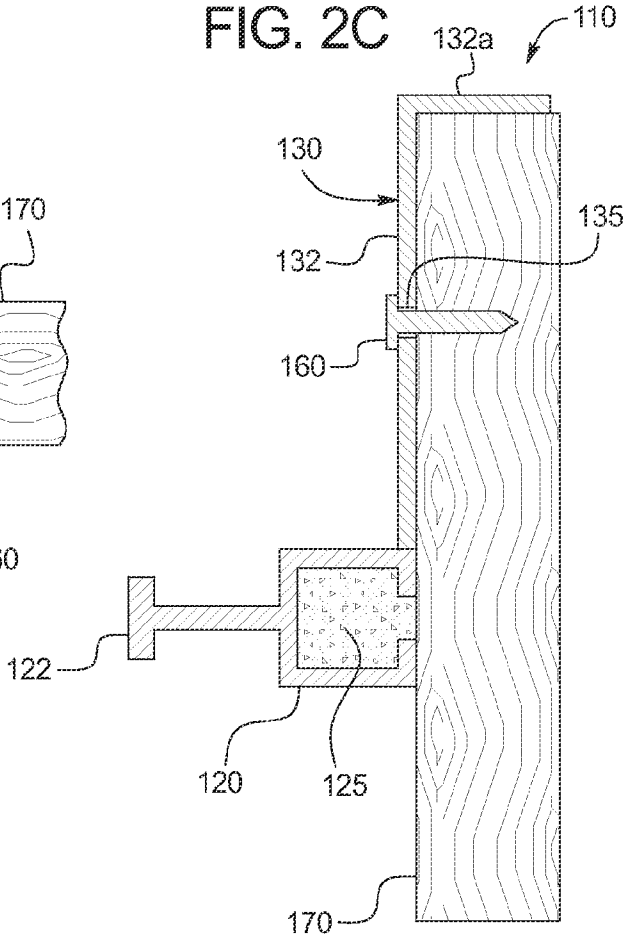
FIG. 2C is a cross-sectional side view of the embedment attachment system of FIG. 2A taken substantially along line 2C-2C of FIG. 2B.
Figure 2B:
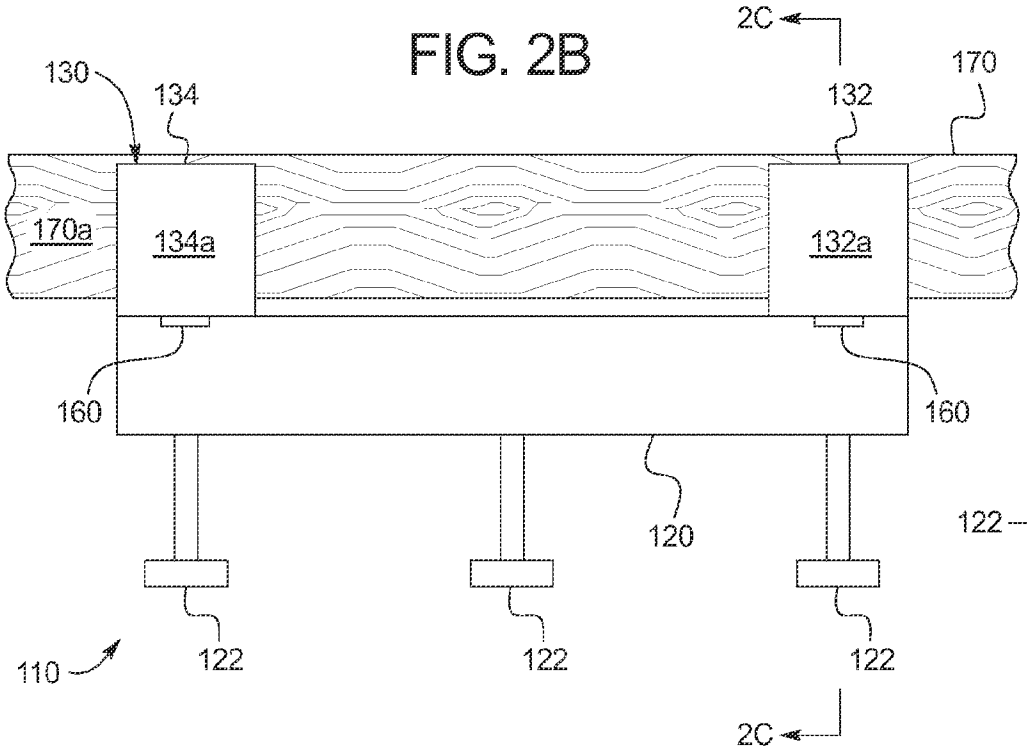
FIG. 2B is a top view of the embedment attachment system of FIG. 2A.

Turning now to FIGS. 2A, 2B, and 2C, another example embodiment of the embedment attachment system of the present disclosure is generally indicated by numeral 110. In this illustrated example, the embedment attachment system 110 includes an embedment 120 attached to an embedment hanger 130.

The embedment 120 includes a plurality of leftwardly extending studs 122 (with respect to the orientation shown in FIGS. 2A and 2C) and defines an embedment channel 125 therethrough that is configured to mount a panel bracket (not shown) to the embedment 120. In this example, the embedment channel 125 is filled with a foam material to prevent concrete from filling the embedment channel 125 when the concrete is poured into the concrete form. After the concrete cures, the foam material is removed from the embedment channel to enable a panel bracket (not shown) to be mounted to the embedment channel.

The embedment hanger 130 includes two hanger arms 132 and 134, each of which has an L-shaped cross section, and a supporting cross brace 136 connecting the hanger arms 132 and 134. Each of the hanger arms 132 and 134 includes a hanger tab 132*a* and 134*a*, respectively, that is sized to extend substantially across a top surface 170*a* of a concrete form 170. In other embodiments, the hanger tabs is sized to extend partially across (such as halfway across, one-third of the way across, or one-quarter of the way across) the top surface of the concrete form. In another embodiment, the hanger arms do not include any hanger tabs. In certain embodiments, the hanger tabs are removable from the hanger arms and/or the hanger arms are removable from the embedment. That is, in such embodiments, once the concrete has been poured and has cured and the concrete form has been removed, a worker may either remove the hanger tabs from the hanger arms (such as by cutting the hanger tabs from the hanger arms or snapping the hanger tabs off of the hanger arms) or remove the hanger arms from the embedment (such as by cutting the hanger arms from the embedment or snapping the hanger arms off of the embedment).

In this illustrated example, the tops of the hanger arms 132 and 134 and, more particularly, the hanger tabs 132*a* and 134*a*, are at a predetermined distance from a centerline of the embedment 120. In other embodiments, the hanger arms have adjustable lengths such that a worker may adjust the distance from the centerline of the embedment to the tops of the hanger arms to alter the edge spacing of the embedment from the concrete form.

In this example, the components of the embedment hanger are attached to one another via welds, though it should be appreciated that the components of the embedment hanger may be attached to one another in any suitable manner. Additionally, in this example, the embedment is attached to the embedment hanger via a weld, though it should be appreciated that the embedment may be attached to the embedment hanger in any suitable manner, such as via snap fit, press fit, or friction fit.

The embedment hanger 130 defines one or more fastener receiving openings therethrough. In this illustrated example, each of the hanger arms 132 and 134 defines a single fastener opening 135 therethrough. It should be appreciated that any suitable components of the embedment hanger may define any suitable number of fastener openings therethrough. As best illustrated in FIG. 2C, the embedment attachment system 110 is configured to be attached to a concrete form 170 via fasteners 160 inserted through the fastener receiving openings and into the concrete form 170. More specifically, the embedment attachment system 110 is attached to the concrete form 170 by first hanging the embedment attachment system 110 off of the top surface 170*a* of the concrete form 170 and then inserting fasteners through the fastener receiving openings and into the concrete form. It should be appreciated that any suitable fasteners, such as nails, tacks, screws, staples, or bolts, may be used to attach the embedment attachment to the concrete form.

It should be appreciated that after the embedment attachment system is attached to the concrete form, the hanger tabs prevent the embedment attachment system from being dislodged or from being shifted from its installed position when jostled, stepped on, or otherwise disturbed. Additionally, because the hanger tabs are at a predetermined distance from the centerline of the embedment, it should be appreciated that after the embedment attachment is attached to the concrete form, the embedment has the proper edge spacing from the concrete form. In other words, use of the embedment attachment system enables precise embedment positioning with respect to the concrete form.

Although this example embedment attachment system is described as including the embedment itself, it should be appreciated that in other embodiments the embedment attachment system does not include the embedment. For instance, the embedment may be sold separately and the embedment attachment system may be attachable to any of a variety of different types and sizes of embedments.

This example embedment attachment solves certain of the above-described problems. More specifically, the configuration of the components of the embedment attachment system (and, specifically, the predetermined distance between the hanger tabs and the centerline of the embedment) does not require a worker to use a tape measure to ensure the embedment has the proper edge spacing from the concrete form, thereby eliminating the potential for human error with respect to this measurement. The embedment attachment system is also not attached to the rebar (or any other reinforcing materials), which reduces the likelihood that any jostling of the rebar will displace the embedment from its desired location. Further, the embedment hanger provides stability and reduces the likelihood that the embedment attachment system will be dislodged (such as when stepped on by a worker), which reduces the likelihood that the embedment will be displaced from its desired location.

Top Mount Embedment Attachment System

Figure 3A:
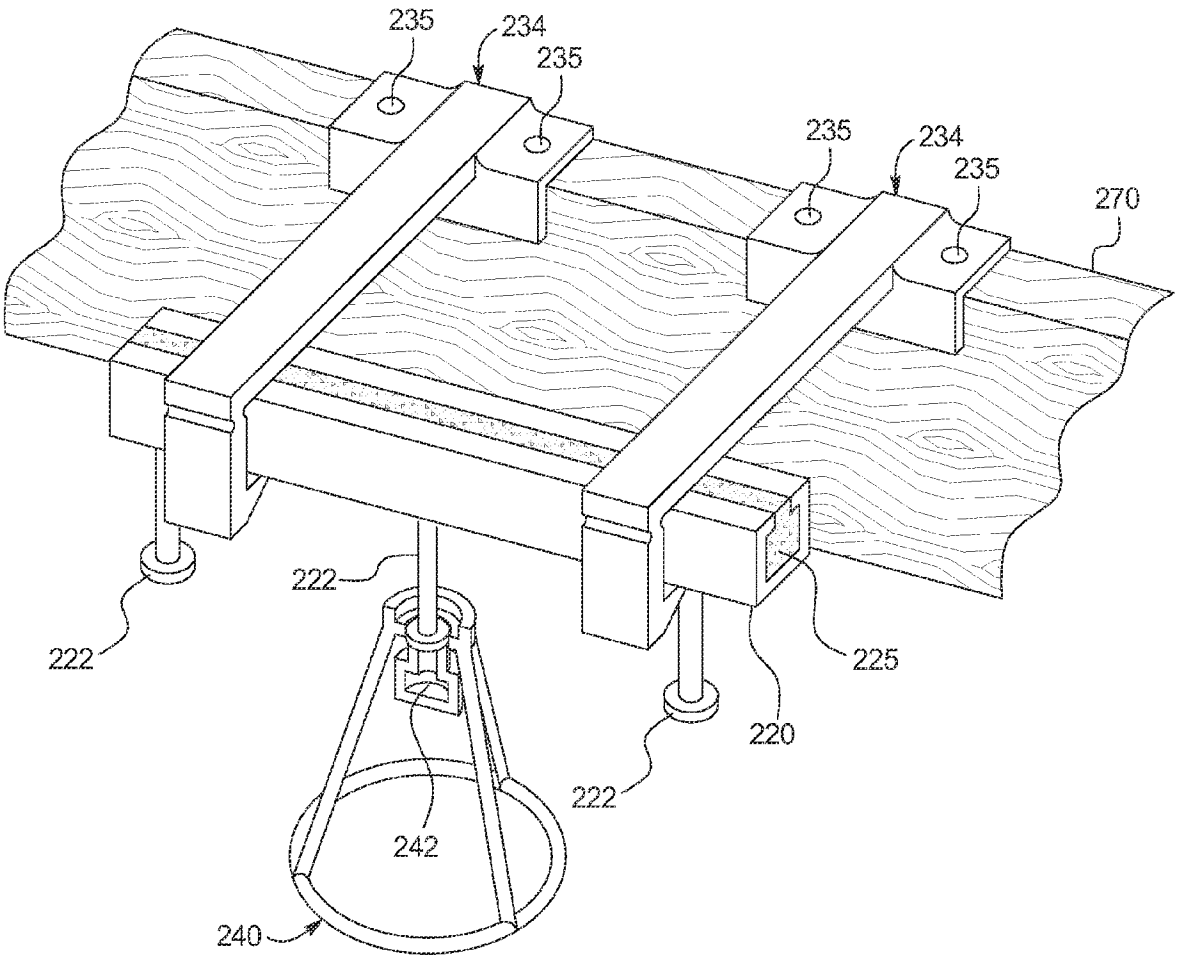
FIG. 3A is a perspective view of another example embodiment of the embedment attachment system of the present disclosure.
Figure 3B:
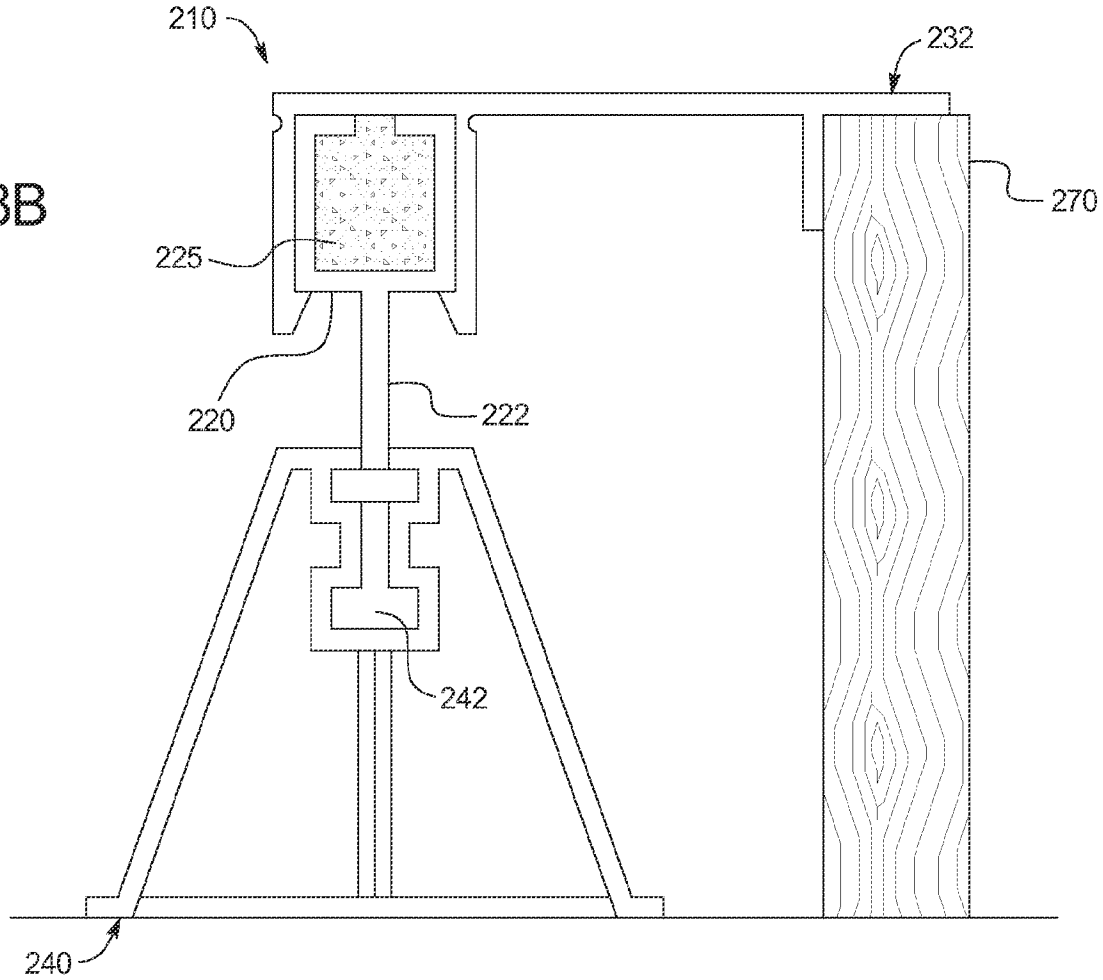
FIG. 3B is a side view of the embedment attachment system of FIG. 3A.

Turning now to FIGS. 3A and 3B, another example embodiment of the embedment attachment system of the present disclosure is generally indicated by numeral 210. In this illustrated example, the embedment attachment system 210 includes an embedment 220 having a plurality of downwardly extending studs 222, a plurality of embedment positioners 232 and 234 each configured to attach at a first end to the embedment 220 and at a second end to a concrete form 270, and at least one embedment support 240 attachable to one of the studs 222 and configured to support the stud 222 at a desired height.

More specifically, each of the embedment positioners 232, 234 includes a first end configured to attach to the embedment 220 end from the top down via a snap fit or any other suitable manner, such as press fit or friction fit. In various embodiments, the first end of the embedment positioner that is configured to snap onto the embedment is sized such that it may be used in conjunction with most manufacturers' embedments. A second end of each of the embedment positioners 232, 234 defines one or more fastener receiving openings 235 therethrough, and is configured to attach to a top surface of the concrete form 270 via suitable fasteners inserted through the fastener receiving openings 235 and into the concrete form 270. In this embodiment, as best illustrated in FIG. 3A, two fastener receiving openings 235 are defined by the second ends of each of the embedment positioners 232 and 234, which provides torsional mounting stability when the fasteners are attached through the fastener receiving openings and to the concrete form.

It should be appreciated that, in this illustrated embodiment, the first and second ends of each of the embedment positioners are a predetermined distance apart from one another. It should also be appreciated that the second end of each of the embedment positioners has an L-shaped profile (though in other embodiments the embedment positioners do not include such a profile). The combination of this predetermined distance and L-shaped second end profile results in the embedment having the proper edge spacing from the concrete form when the embedment positioners are attached to the concrete form. In other embodiments, the embedment positioners have adjustable lengths such that a worker may adjust the distance from the centerline of the embedment to the concrete form to alter the edge spacing of the embedment from the concrete form.

As noted above, the embedment attachment system 210 also includes at least one embedment support 240, each of which is attachable to one of the studs 222 of the embedment 220. More specifically, the embedment support 240 defines one or more mating recesses 242 configured to receive one of the studs 222. Once one of the mating recesses 242 receives one of the studs 222, the embedment support 240 is configured to support the stud 222 at a desired height, which ensures that the embedment 220 is held upright at that desired height. In this example, the desired height is determined such that the embedment 220 is held level with the top of the concrete form 270. While a single embedment support is illustrated in this example, it should be appreciated that any suitable quantity of embedment supports may be utilized.

In these examples, multiple mating recesses are employed to enable the embedment support to be used with different desired embedment heights, which may vary depending on the height of the concrete form (and on the eventual concrete slab thickness). In other embodiments, however only a single mating recess is employed. In further embodiments, the height of the mating recess is adjustable, which enables a worker to alter the height of the mating recess to any desired height.

In this example, the embedment 220 defines an embedment channel 225 therethrough that is configured to mount a panel bracket (not shown) to the embedment 220. In this example, the embedment channel 225 is filled with a foam material to prevent concrete from filling the embedment channel 225 when the concrete is poured into the concrete form. After the concrete cures, the foam material is removed from the embedment channel to enable a panel bracket (not shown) to be mounted to the embedment channel.

In one embodiment, the embedment positioners are made of plastic. In another embodiment, the embedment positioners each include a plurality of snap off locations that enable a portion of that embedment positioner to be removed after the concrete has been poured and has cured. It should be appreciated that the components of the embedment attachment system may be made from any suitable materials.

Figure 3C:
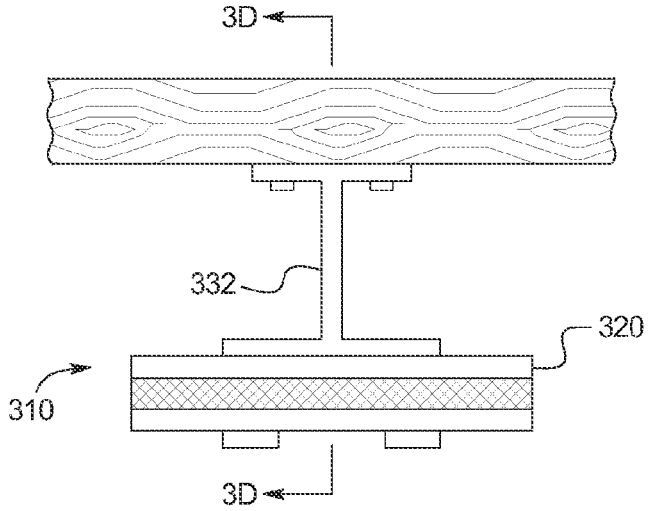
FIG. 3C is a top view of another example embodiment of the embedment attachment system of the present disclosure.
Figure 3D:
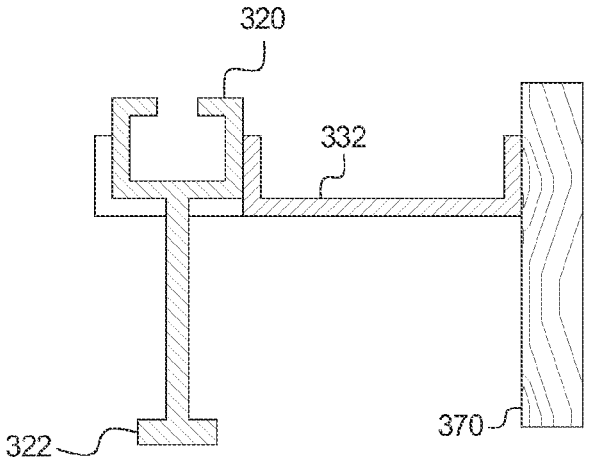
FIG. 3D is a side cross-sectional view of the embedment attachment system of FIG. 3C taken substantially along line 3D-3D of FIG. 30.
Figure 3E:
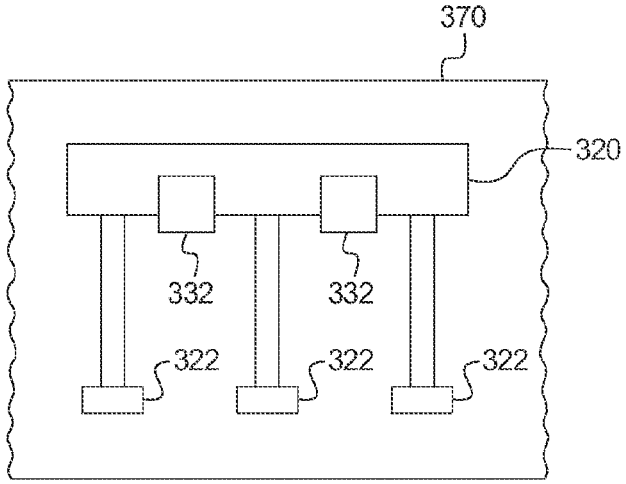
FIG. 3E is a front view of the embedment attachment system of FIG. 30.

FIGS. 3C, 3D, and 3E illustrate another example embodiment of the embedment attachment system of the present disclosure. In this example, the embedment attachment system 310 includes an embedment 320 having a plurality of downwardly extending studs 322, an embedment positioner 332 configured to attach at a first end to the embedment 320 and at a second end to a concrete form 370. In this example, a first end of the embedment positioner 332 is configured to attach to the embedment 320 from the bottom up via a friction fit, A second end of the embedment positioner 332 defines one or more fastener receiving openings therethrough, and is configured to attach to an interior surface of the concrete form 370 via suitable fasteners inserted through the fastener receiving openings and into the concrete form 370.

Although this example embedment attachment system is described as including the embedment itself, it should be appreciated that in other embodiments the embedment attachment system does not include the embedment. For instance, the embedment may be sold separately and the embedment attachment system may be attachable to any of a variety of different types and sizes of embedments.

This example embedment attachment system solves certain of the above-described problems. More specifically, the configuration of the components of the embedment attachment system (and, specifically, this predetermined distance between the first and second ends of the embedment positioners and the L-shaped second end profile of the embedment positioners) does not require a worker to use a tape measure to ensure the embedment has the proper edge spacing from the concrete form, thereby eliminating the potential for human error with respect to this measurement. The embedment attachment system is also not attached to the rebar (or any other reinforcing materials), which reduces the likelihood that any jostling of the rebar will displace the embedment from its desired location. Further, the embedment attachment system and, more specifically, the embedment support, provides stability to the embedment to reduce the likelihood that the embedment will be dislodged (such as when stepped on by a worker), which reduces the likelihood that the embedment will be displaced from its desired location.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An embedment attachment system comprising:

a panel bracket holder including:

(a) two spaced-apart side plates;

(b) two spaced-apart base plates, each base plate attached to and extending between the two side plates;

(c) an embedment (i) attached to and extending between the two spaced-apart base plates, (ii) attached to and extending between the two spaced-apart side plates, (iii) defining an embedment channel extending therethrough, and (iv) including a plurality of studs connected thereto and extending therefrom; and (d) a back plate attached to and extending between the side plates;

a removable protective cover attachable to at least one of: (i) the side plates, and (ii) the back plate; and a panel bracket removably attachable to the embedment such that the panel bracket abuts at least one of the base plates.

2. The embedment attachment system of claim 1, wherein the base plates, the embedment, the side plates, and the back plate define a mounting pocket, the panel bracket being removably attachable to the embedment within the mounting pocket.

3. The embedment attachment system of claim 2, wherein the removable protective cover encloses the mounting pocket and the panel bracket when: (A) the panel bracket is removably attached to the embedment in a first position, and (B) the removable protective cover is attached to the at least one of (i) the side plates, and (ii) the back plate.

4. The embedment attachment system of claim 1, wherein the embedment has a rectangular cross section.

5. The embedment attachment system of claim 1, wherein each of the side plates defines one or more material passages therethrough.

6. The embedment attachment system of claim 5, wherein at least one of the material passages defined by at least one of the side plates extends to an edge of said at least one of the side plates.

7. The embedment attachment system of claim 1, which includes a first fastening flange attached to and extending transversely from one of the side plates and a second fastening flange attached to and extending transversely from another one of the side plates.

8. The embedment attachment system of claim 1, which includes at least one bolt and at least one nut.

9. The embedment attachment system of claim 8, wherein a first end of the at least one bolt is disposed within the embedment channel and the at least one bolt extends through a mounting opening defined by the panel bracket such that the at least one bolt is configured to engage the at least one nut.

10. The embedment attachment system of claim 9, which includes at least one locking washer, the at least one bolt configured to extend through the at least one locking washer such that the at least one bolt is configured to engage the at least one nut.

11. The embedment attachment system of claim 10, wherein an upper surface of the panel bracket includes a plurality of locking ridges and a lower surface of the locking washer includes a plurality of locking ridges configured to engage the locking ridges of the panel bracket.

12. An embedment attachment system comprising:

a panel bracket holder including:

(a) two spaced-apart side plates;

(b) two spaced-apart coplanar base plates, each base plate attached to and extending between the two side plates;

(c) an embedment (i) attached to and extending between the two spaced-apart base plates, (ii) attached to and extending between the two spaced-apart side plates, (iii) defining an embedment channel extending therethrough, and (iv) including a plurality of studs connected thereto and extending therefrom; and (d) a back plate attached to and extending between the side plates; and a removable protective cover attachable to at least the back plate.

13. The embedment attachment system of claim 12, which includes a panel bracket removably attachable to the embedment such that the panel bracket abuts at least one of the base plates.

14. The embedment attachment system of claim 13, wherein the base plates, the embedment, the side plates, and the back plate define a mounting pocket, the panel bracket being removably attachable to the embedment within the mounting pocket.

15. The embedment attachment system of claim 14, wherein the removable protective cover encloses the mounting pocket and the panel bracket when: (A) the panel bracket is removably attached to the embedment in a first position, and (B) the removable protective cover is attached to the back plate.

16. The embedment attachment system of claim 12, wherein each of the side plates defines one or more material passages therethrough.

17. The embedment attachment system of claim 16, wherein at least one of the material passages defined by at least one of the side plates extends to an edge of said at least one of the side plates.

18. The embedment attachment system of claim 12, wherein the embedment has a rectangular cross section.

19. The embedment attachment system of claim 12, which includes a first fastening flange attached to and extending transversely from one of the side plates and a second fastening flange attached to and extending transversely from another one of the side plates.

20. The embedment attachment system of claim 12, wherein the removable protective cover is attachable to at least one of the side plates in addition to the back plate.

21. A panel bracket holder comprising:

(a) two spaced-apart side plates;

(b) two spaced-apart coplanar base plates, each base plate attached to and extending between the two side plates;

(c) an embedment (i) attached to and extending between the two spaced-apart base plates, (ii) attached to and extending between the two spaced-apart side plates, (iii) defining an embedment channel extending therethrough, and (iv) including a plurality of studs connected thereto and extending therefrom; and (d) a back plate attached to and extending between the side plates and attached to and extending transversely from a first one of the base plates.

22. The panel bracket holder of claim 21, wherein a panel bracket is removably attachable to the embedment such that the panel bracket abuts at least one of the base plates.

23. The panel bracket holder of claim 22, wherein the base plates, the embedment, the side plates, and the back plate define a mounting pocket, the panel bracket being removably attachable to the embedment within the mounting pocket.

24. The panel bracket holder of claim 23, wherein a removable protective cover encloses the mounting pocket and the panel bracket when: (A) the panel bracket is removably attached to the embedment in a first position; and (B) the removable protective cover is attached to at least one of (i) the side plates, and (ii) the back plate.

25. The panel bracket holder of claim 21, wherein each of the side plates defines one or more material passages therethrough.

26. The panel bracket holder of claim 25, wherein at least one of the material passages defined by at least one of the side plates extends to an edge of said at least one of the side plates.

27. The panel bracket holder of claim 21, wherein the embedment has a rectangular cross section.

28. The panel bracket holder of claim 21, which includes a first fastening flange attached to and extending transversely from one of the side plates and a second fastening flange attached to and extending transversely from another one of the side plates.

29. An embedment attachment system comprising:

a panel bracket holder including:

(a) two spaced-apart side plates;

(b) two spaced-apart base plates, each base plate attached to and extending between the two side plates;

(c) an embedment (i) attached to and extending between the two spaced-apart base plates, (ii) attached to and extending between the two spaced-apart side plates, and (iii) defining an embedment channel extending therethrough; and (d) a back plate attached to and extending between the side plates;

a removable protective cover attachable to at least one of: (i) the side plates, and (ii) the back plate; and a panel bracket removably attachable to the embedment such that the panel bracket abuts at least one of the base plates, the panel bracket defining a mounting opening therethrough;

at least one bolt having a first end and a second end, the first end of the at least one bolt being disposable within the embedment channel such that the at least one bolt extends through the mounting opening of the panel bracket and the second end of the at least one bolt protrudes from the mounting opening; and at least one nut threadable onto the second end of the at least one bolt.

30. The embedment attachment system of claim 29, which includes at least one locking washer positionable on the at least one bolt between the at least one nut and the panel bracket.

31. The embedment attachment system of claim 30, wherein an upper surface of the panel bracket includes a plurality of locking ridges and a lower surface of the locking washer includes a plurality of locking ridges engageable with the locking ridges of the panel bracket.

* * * * *